US006137215A

United States Patent [19]

Kondo et al.

[11] Patent Number: 6,137,215

[45] Date of Patent: Oct. 24, 2000

[54] FIELD EMISSION CATHODE SUPPORTING STRUCTURE

[75] Inventors: Yuji Kondo; Akihiro Yano, both of Tokyo, Japan

[73] Assignee: NEC Corporation, Tokyo, Japan

[21] Appl. No.: 08/974,995

[22] Filed: Nov. 20, 1997

[30] Foreign Application Priority Data

Nov. 25, 1996 [JP] Japan ..... 8-313464

[51] Int. Cl.[7] ..... H01J 1/30; H01J 19/24

[52] U.S. Cl. ..... 313/414; 313/309; 313/336; 313/306

[58] Field of Search ..... 313/309, 336, 313/351, 310, 306, 308, 446, 447, 412, 414

[56] References Cited

U.S. PATENT DOCUMENTS

| | | | |
|---|---|---|---|
| 5,604,401 | 2/1997 | Makishima | 313/309 |
| 5,786,657 | 7/1998 | Okamoto | 313/308 |
| 5,814,931 | 9/1998 | Makishima | 313/309 |

FOREIGN PATENT DOCUMENTS

| | | | |
|---|---|---|---|
| 7-161304 | 6/1995 | Japan | H01J 29/04 |
| 7-201273 | 8/1995 | Japan | H01J 1/30 |

*Primary Examiner*—Michael Day
*Attorney, Agent, or Firm*—Sughrue, Mion, Zinn, Macpeak & Seas, PLLC

[57] ABSTRACT

A ceramic substrate for mounting a field emission cathode is secured on the lower surface of a metal flange for assembly of an electron lens of a cathode ray tube, and the mounting position of the field emission cathode on the ceramic substrate is determined with reference to the metal flange.

14 Claims, 9 Drawing Sheets

FIELD EMISSION CATHODE SUPPORTING STRUCTURE

BACKGROUND OF THE INVENTION

1. Field of the Invention

This invention relates to an electron gun of a cathode ray tube, particularly to a supporting structure for a field emission cathode.

2. Description of the Related Art

A field emission cathode includes a large number of very small field emission type cathodes arranged in an array on a conductive substrate to form an emission area for discharging electrons. The field emission cathode has many advantages compared to conventional hot cathodes and is expected to be applied to various fields.

FIGS. 1*a* and 1*b* show a plan view and an enlarged sectional view of an example of a field emission cathode, respectively. The field emission cathode generally includes several hundred to several tens of thousands of field emission cathodes 22 each in the form of a very small micron-size cone arranged in an array of a circular, square or some other suitable shape on a semiconductor substrate 21 to form an emission area 23 for emitting electrons, and a gate electrode 24 in the form of a mesh for applying a very strong electric field to the very small projection-like cathodes formed above the emission area with an insulating layer 25 interposed therebetween. Further, in the example of FIGS. 1*a* and 1*b*, focusing electrode 26 is formed around an outer periphery of the gate electrode set with the insulating layer 25 interposed therebetween. Reference numeral 27 denotes a chip positioning mark, and 28 denotes bonding pads for gate electrode 24 and focusing electrode 26.

When a voltage is applied between gate electrode 24 and the set of micron-size cathode cones in emission area 23, the electric field concentrates at the pointed end of cones 22, and amounts of electrons corresponding to the potential difference between both electrodes are discharged in the directions indicated by arrow marks 29 from the apexes of the pointed end portions of the field emission cathode cones 22. Where the diameter of the very small cones is set to approximately 1 $\mu$m, when a voltage of approximately 50 to 100 V is applied between the set of micron-size field emission cathode cones of the emission area 23 and gate electrode 24, electrons of approximately 1 $\mu$A are discharged from each micron-size emission cone. Therefore, while a field emission cathode for use with an ordinary Braun tube has approximately several thousands to several tens of thousands of micron-size cones formed thereon, the area of emission area 23 is approximately several hundreds $\mu m^2$ because the diameter of the micron-size cone is as small as approximately 1 $\mu$m. Further, an electron beam discharged is focused by focusing electrode 26 to make a finely converged electron beam.

Next, a supporting structure is described for a field emission cathode having a structure wherein a ceramic substrate used with a semiconductor is adhered to a metal flange for assembly of an electron lens. FIGS. 2*a* and 2*b* show an example of a conventional field emission cathode structure body on which three field emission cathodes are carried, and FIG. 2*a* is a top plan view and FIG. 2*b* is an enlarged sectional view taken along line A–A' of FIG. 2*a*. It is to be noted that, in the sectional view of FIG. 2*b*, a first grid electrode of an electron lens positioned nearest is shown.

The field emission cathode supporting structure shown in FIGS. 2*a* and 2*b* includes ceramic substrate 42, terminals 44, and metal flange 45. Ceramic substrate 42 is supported at a lower surface thereof on an upper surface of metal flange 45. Ceramic substrate 42 and terminals 44, and ceramic substrate 42 and metal flange 45, are secured to each other respectively by brazing. Field emission cathode mounting reference patterns 47, field emission cathode mounting patterns 48 and wire bonding patterns 49 are formed on the upper surface of ceramic substrate 42. Those patterns are all plated with gold and connected to terminals 44 brazed on the lower surface of ceramic substrate 42.

Ceramic substrate 42 has a multiple layer structure of at least three layers including a device mounting pattern layer, a terminal connecting pattern layer and a layer for optimizing the positions of the patterns. Therefore, ceramic substrate 42 has a thickness of at least 1 mm. This thickness has a thickness dispersion of approximately ±10% of the maximum thickness, that is, approximately ±100 $\mu$m arising from a dispersion in coefficient of contraction upon baking of the ceramic substrate. Metal flange 45 has electron lens assembly reference holes 50 formed therein for combining metal flange 45 with an electron lens including first grid electrode 46. Terminals 44 are provided to connect field emission cathode mounting patterns 48 and wire bonding patterns 49 to the outside.

Field emission cathodes 41 are mounted on field emission cathode mounting patterns 48 of ceramic substrate 42 at the positions calculated with reference to the positions of field emission cathode mounting reference patterns 47 formed on ceramic substrate 42.

The gate electrodes and the focusing electrodes of field emission cathode 41 are connected to field emission cathode mounting patterns 48 and wire bonding patterns 49 on the ceramic substrate 42 by aluminum wires, gold wires or other suitable wires 43. The patterns to which the gate electrodes and the focusing electrodes are connected are connected to terminals 44 brazed to the lower surface of ceramic substrate 42 through through-holes which extend through multiple layer ceramic substrate 42.

In the structure of the conventional field emission cathode structure body described above, since ceramic substrate 42 on which field emission cathodes 41 are to be mounted is provided on the upper surface of metal flange 45, the gap distance between the electron discharging plane of the field emission cathodes 41 and the inner surface of first grid electrode 46 opposing the electron discharging plane is both in the dispersion of the thickness of ceramic substrate 42 (approximately ±100 $\mu$m mentioned hereinabove) and the dispersion of the thickness of field emission cathodes 41 themselves (approximately ±15 $\mu$m).

Further, while the mounting positions of field emission cathodes 41 are defined by field emission cathode mounting reference patterns 47 on ceramic substrate 42 and the electron lens including first grid electrode 46 is assembled with reference to metal flange 45, since the accuracy in assembly of the metal flange and the ceramic substrate depends upon the accuracy in dimensions of a jig which is used upon brazing of the metal flange and the ceramic substrate and is approximately ±100 to 200 $\mu$m, the positions of first grid electrode 46 and the emission areas of the field emission elements 41 are dispersed approximately by an amount corresponding to the tolerance in brazing of ceramic substrate 42 and metal flange 45 (approximately ±100 to 200$\mu$m)+the tolerance in mounting of field emission cathodes 41 on the ceramic substrate.

As examples of conventional field emission cathode structure bodies, Japanese Patent Laid-Open No. 161304/95 and Japanese Patent Laid-Open No. 201273/95 are known and described below.

FIG. 3*a* shows a perspective view of a field emission cathode structure body disclosed in Japanese Patent Laid-Open No. 161304/95, and FIG. 3*b* shows a sectional view of the structure body. Field emission cathode structure body 60 includes field emission cathodes 65 securely mounted on chip holder 62 in the form of a cap having window holes 61 formed in a top wall thereof such that emission areas 63 are exposed through window holes 61 of chip holder 62, and contact areas 64 of field emission cathodes 65 contact with peripheral portions of the inner surface around window holes 61. Each of field emission cathodes 65 is shown in a manner in which it is pressed against chip holder 62 by resilient connecting piece 67.

FIG. 4 is a schematic view showing an appearance of a cathode structure body of field emission cathodes disclosed in Japanese Patent Laid-Open No. 201273/95. The front face of FIG. 4 shows a sectional view, and gate electrode 73 is connected from the front surface to first lead electrode 76 provided on the rear surface of the structure body through a contact hole 75 made of conductor 77. Field emission cones 74 are electrically connected to second lead electrode 78 through substrate 71. When the field emission cathodes are to be mounted onto some substrate, electrodes individually corresponding to first lead electrode 76 and second lead electrode 78 are formed, and the lead electrodes are connected to the electrodes on the substrate side. By such a connection method as described above, there is no need for providing connection means such as wire bonding on the front surface side of the field emission cathode. While it is common with the invention of the present application in that electric connections are wired to the rear surface using through-holes, the field emission cathode structure body does not have a structure which considers a mounting accuracy of field emission cathode or an accuracy in dimension of the distance from a first grid electrode.

The two disclosures above are directed to eliminate the necessity for wiring bonding on the front surface side of a field emission cathode. Even though they are somewhat similar to the invention of the present application, there is no disclosure regarding the improvement in accuracy in position in mounting a field emission cathode on a field emission cathode structure body for a cathode ray tube or the like.

The necessity for mounting a field emission cathode with a high degree of accuracy is described in connection with factors which determine the mounting accuracy when a field emission cathode is mounted onto a Braun tube. FIG. 5 is a schematic diagrammatic view showing a structure of a Braun tube, and FIG. 6 is a schematic view showing a structure of an electron lens in the Braun tube. The electron lens shown in FIG. 6 includes first grid 31, second grid 32, third grids 33 and 34, and fourth grid 35. Reference numeral 36 denotes bonding glass.

Referring to FIG. 5 in which a construction of a Braun tube is shown, electron beams 88 discharged from field emission cathodes are focused by electron lens 82 disposed in an opposing relationship to field emission cathode structure 81 and formed from the first to fourth grid electrodes, pass through shadow mask 83 and are finally irradiated upon fluorescent screen 87 on the inner surface of a panel to develop a predetermined color. The typical size of fluorescent dots which form pixels of the individual colors of the fluorescent screen 87 is approximately $\phi 100$ $\mu$m, and the spot diameter of the electron beams 88 on the fluorescent material is equal to a size which makes it possible for the electron beams to be irradiated upon a plurality of dots of the fluorescent screen at one time. The reason is that, when the electron beam scans the fluorescent screen, the fluorescent material dots may successively emit light. If it is assumed that the electron beams are restricted to such a size that they can be irradiated upon approximately one to two dots of the fluorescent screen, then the electron beam is intercepted by the shadow mask and a display screen gives a visually stiff feeling.

Further, with a large size Braun tube, since there is a tendency that the spot of the electron beams is expanded by deterioration of the focusing characteristic of the electron lens, it is necessary to further reduce the spot diameter. Therefore, the accuracy in combining of the center axes of R, G and B holes of the individual electrodes of the electron lens is very high and ranges approximately from several $\mu$m to 10 $\mu$m. In other words, the accuracy in assembly of the electron gun is set so that the focusing dispersion of the electron beams and the position dispersion on the fluorescent screen may be sufficient to fall within an allowable range.

In the case of field emission cathodes, an image focused on the fluorescent material dots is an image as a point light source in an emission area. Accordingly, the mounting position accuracy in a plane perpendicular to the electron beam advancing directions of the field emission cathodes reflects the position accuracy of the fluorescent material dots.

Meanwhile, the mounting position accuracy in a plane parallel to the electron beam advancing directions, that is, the gap distance between the first grid electrode and the field emission cathodes, is a parameter in the design of the lens. Accordingly, if the gap distance is different from a designed value, a different lens characteristic is provided, resulting in an out-of-focus state.

For the reasons described above, a high degree of accuracy is required for the mounting positions of the field emission cathodes. However, conventionally the accuracy of the gap between the field emission cathodes and the first grid and the mounting accuracy of the field emission cathodes and the first grid openings in a horizontal plane are not sufficiently taken into consideration and exhibit dispersions of approximately ±100 m and approximately ±100 to 200 $\mu$m, respectively.

SUMMARY OF THE INVENTION

It is an object of the present invention to provide a supporting structure for a field emission cathode structure body having field emission cathode mounted thereon and hence for an electron gun, wherein (1) the dislocation of the gap distance between field emission cathode and a first grid of an electron gun is controlled so as to be remain within a predetermined tolerance (approximately ±20 $\mu$m) and (2) the dislocation of the center of the field emission cathode from the center axis of the electron lens with reference to the first grid is controlled so as to remain within a predetermined tolerance (±several $\mu$m). This means that the positional dislocation between the center of the emission area of field emission cathode and the center axes of lens holes of all grid electrodes are controlled so as to be within a range of ± several $\mu$m.

A field emission cathode supporting structure of the present invention comprises at least one field emission cathode having a sufficient amount micron-size field emission type cathodes formed on a conductive substrate and a gate electrode which applys a voltage to the cathode, a ceramic substrate for mounting such field emission cathode on the upper surface thereof, and a metal flange for supporting the ceramic substrate, wherein the ceramic substrate is fixed at the upper surface thereof to the metal flange.

Further, the metal flange has positioning reference holes for defining a position of the field emission cathode on the ceramic substrate. The metal flange which supports the ceramic substrate also supports the nearest one of the grid electrodes of the electron gun which focuses and accelerates a flow of electrons discharged from the field emission cathode.

As described above, in the field emission cathode supporting structure of the present invention, by supporting the upper surface of the ceramic substrate, which has a dispersion in thickness of approximately ±100 μm, on the lower surface of the metal flange, the dispersion in gap distance between the field emission cathode and the first grid electrode is improved to the range of ±20 μm which is the dispersion of the thickness of the field emission cathode itself. Further, by determining the mounting position of the field emission cathode on the ceramic substrate with reference to the metal flange similarly as in assembly of the electron lens, the dislocation between the center of the field emission cathode and the center axis of the electron lens is improved to the range of ± several μm.

DETAILED DESCRIPTION OF THE EMBODIMENTS

In the following, embodiments of the present invention are described with reference to the drawings.

(Embodiment 1)

Figure 1A:
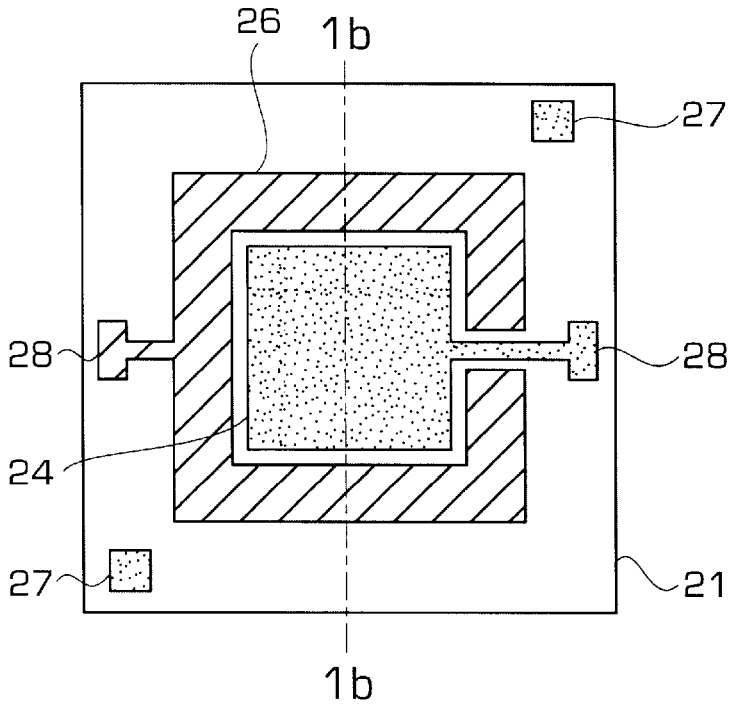
FIG. 1*a* is a plan view showing an example of a field emission cathode.
Figure 1B:
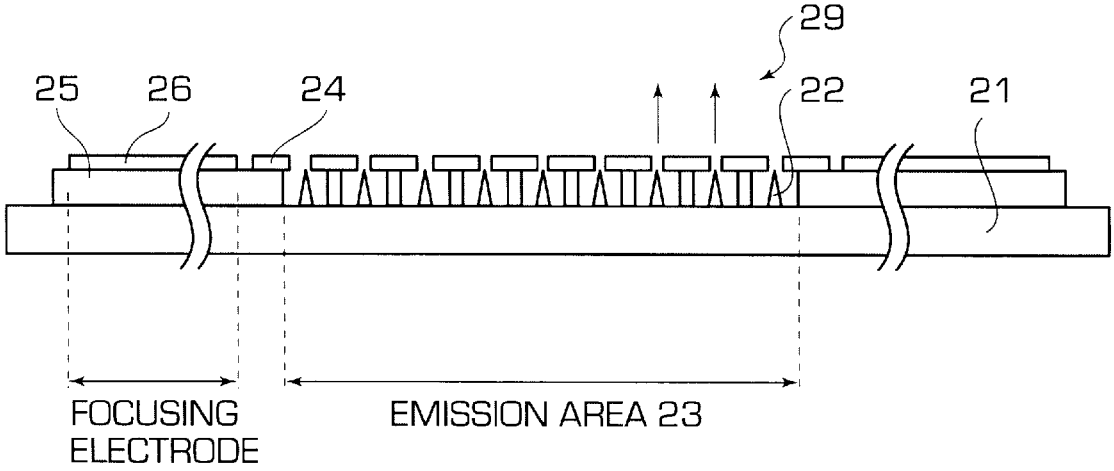
FIG. 1*b* is an enlarged sectional view taken along line A–A' of FIG. 1*a;*
Figure 2A:
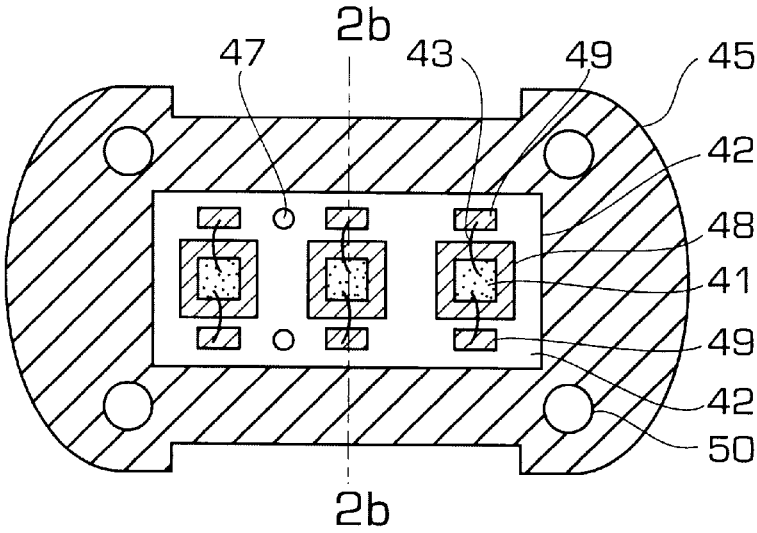
FIG. 2a PRIOR ART
FIG. 2*a* is a plan view of a conventional field emission cathode structure body.
Figure 2B:
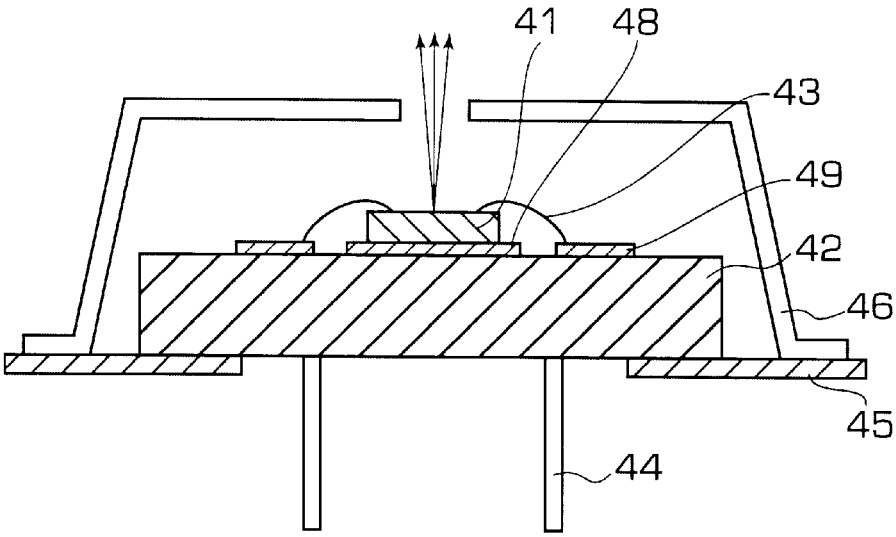
FIG. 2b PRIOR ART
FIG. 2*b* is an enlarged sectional view taken along line A–A' of FIG. 2*a* (including a first grid electrode)
Figure 3A:
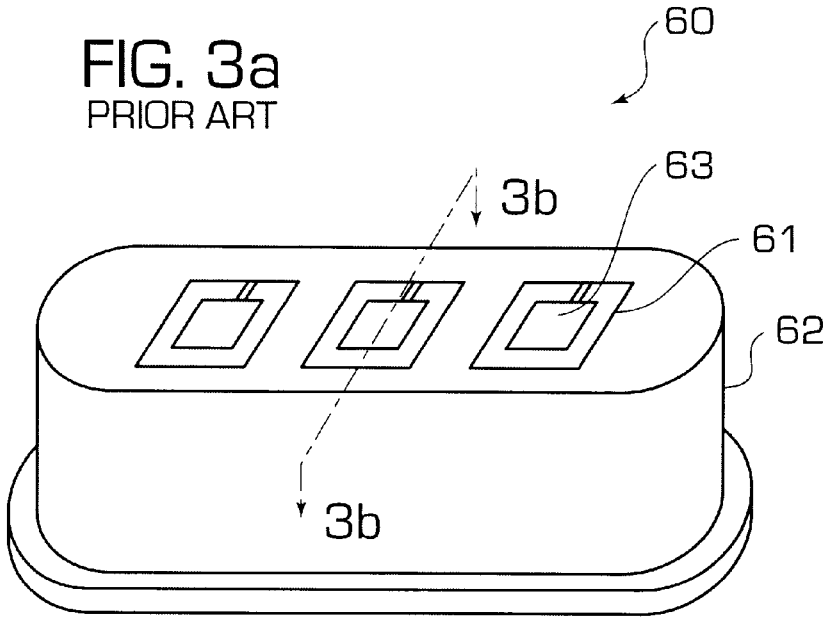
FIG. 3a PRIOR ART
FIG. 3*a* is a perspective view of a field emission cathode structure body disclosed in Japanese Patent Laid-Open No. 161304/95.
Figure 3B:
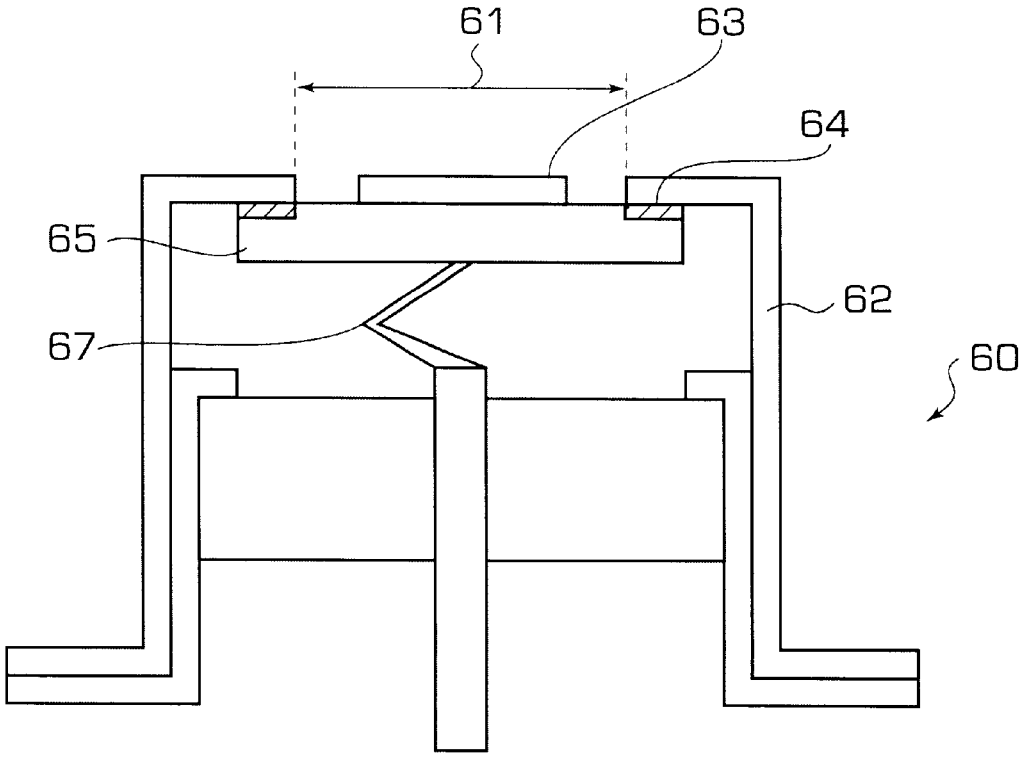
FIG. 3b PRIOR ART
FIG. 3*b* is a sectional view taken along line A–A' of FIG. 3*a*.
Figure 4:
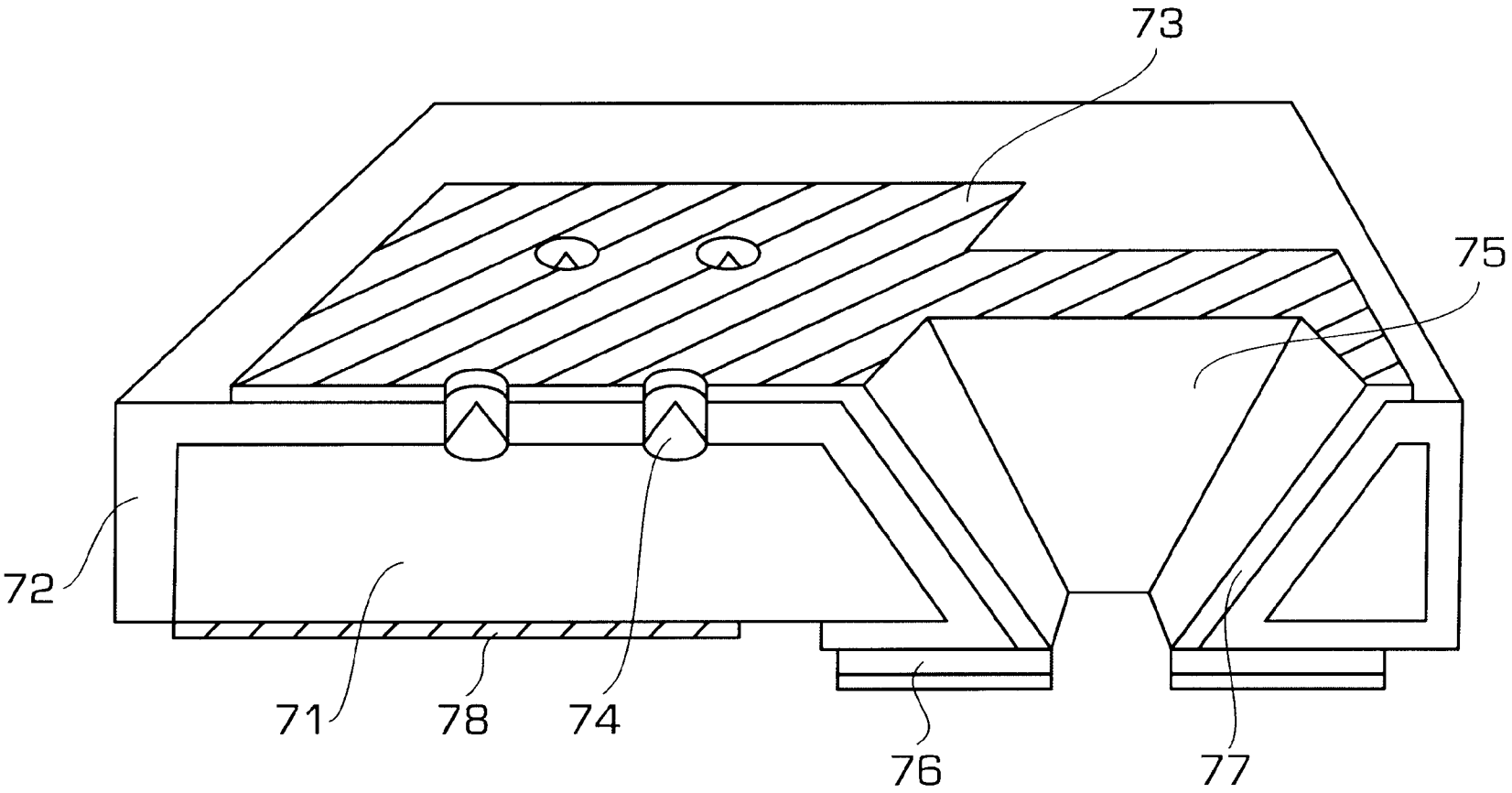
FIG. 4 PRIOR ART
FIG. 4 is schematic view showing an appearance of a field emission cathode structure body including a section disclosed in Japanese Patent Laid-Open No. 210273/95.
Figure 5:
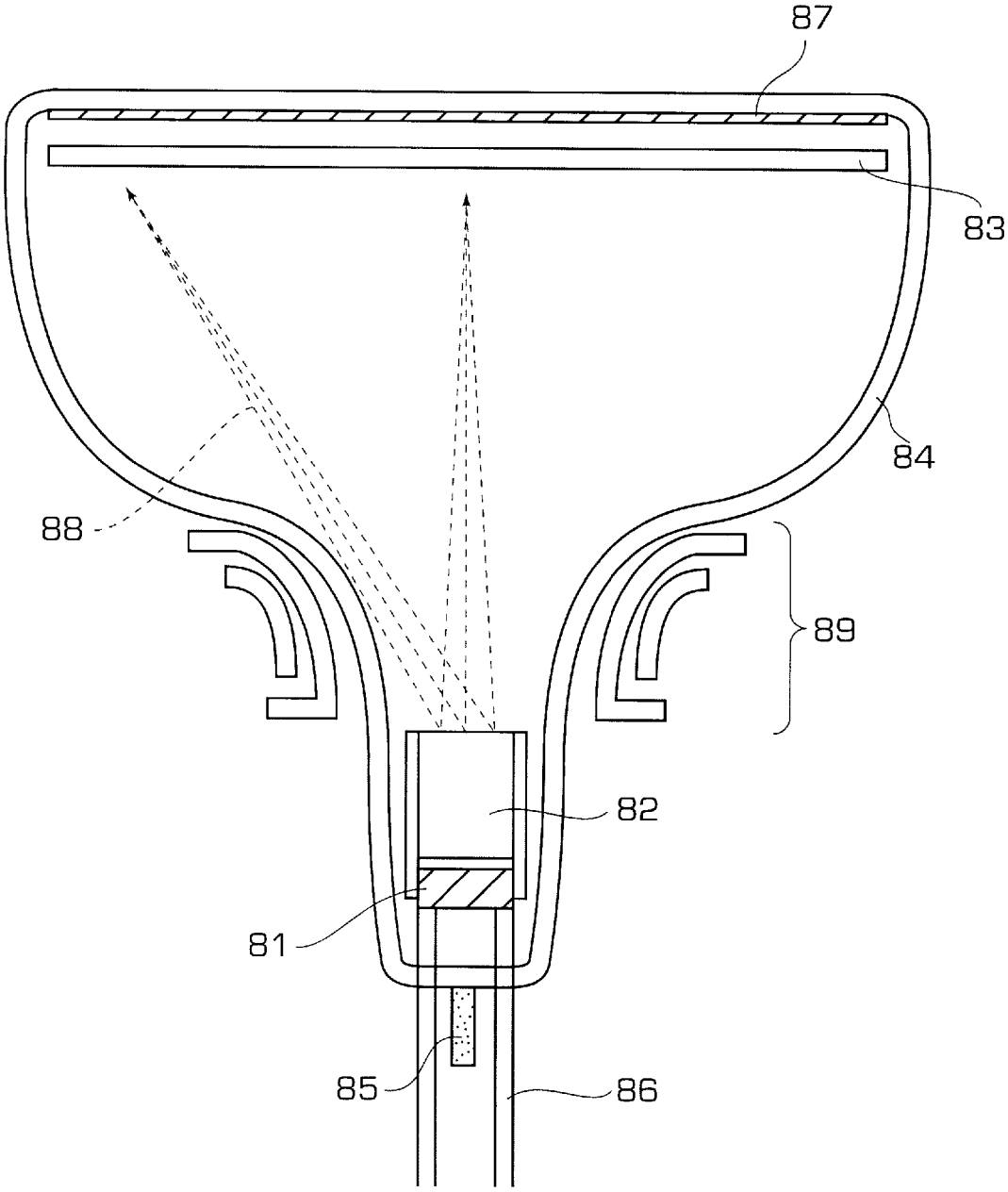
FIG. 5 is a sectional view showing a structure of a Braun tube.
Figure 6:
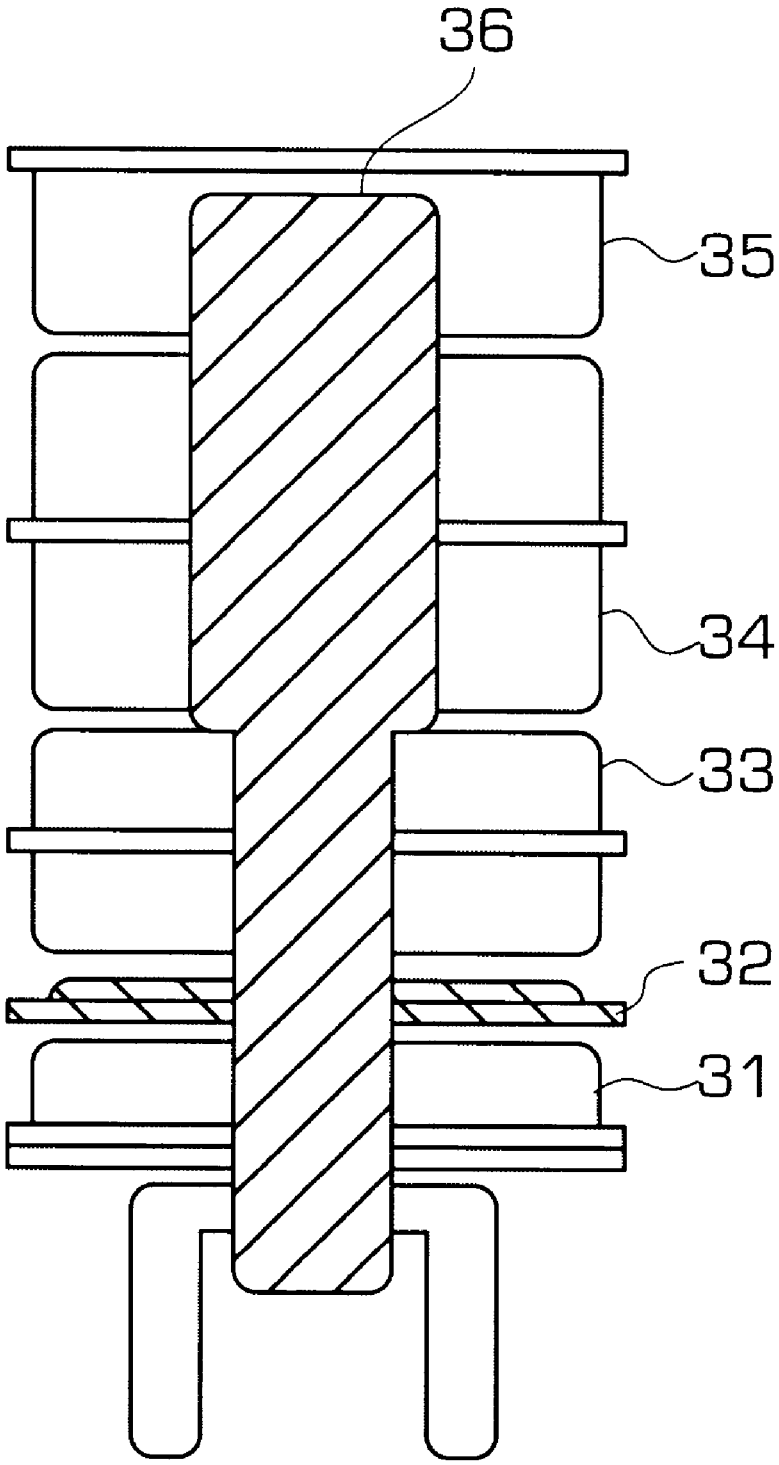
FIG. 6 is a sectional view showing a structure of an electron lens.
Figure 7A:
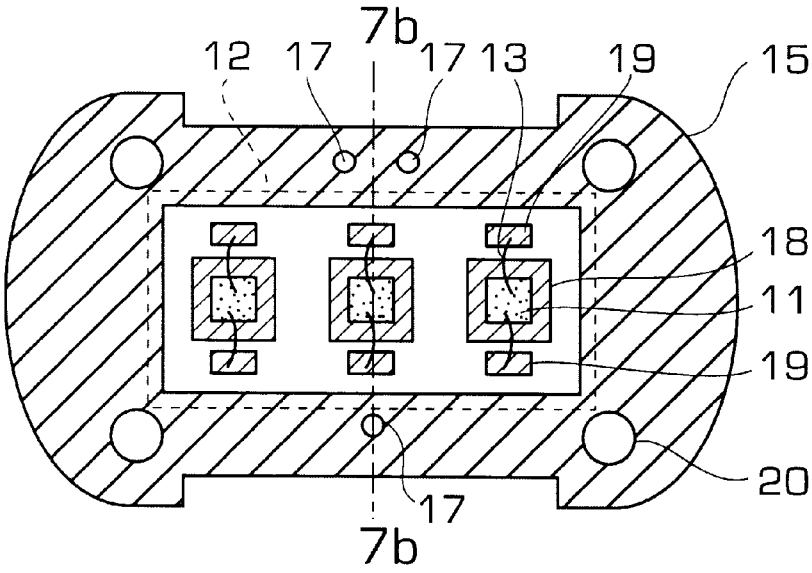
FIG. 7*a* is a plan view of a field emission cathode structure body showing an embodiment of a field emission cathode supporting structure of the present invention.
Figure 7B:
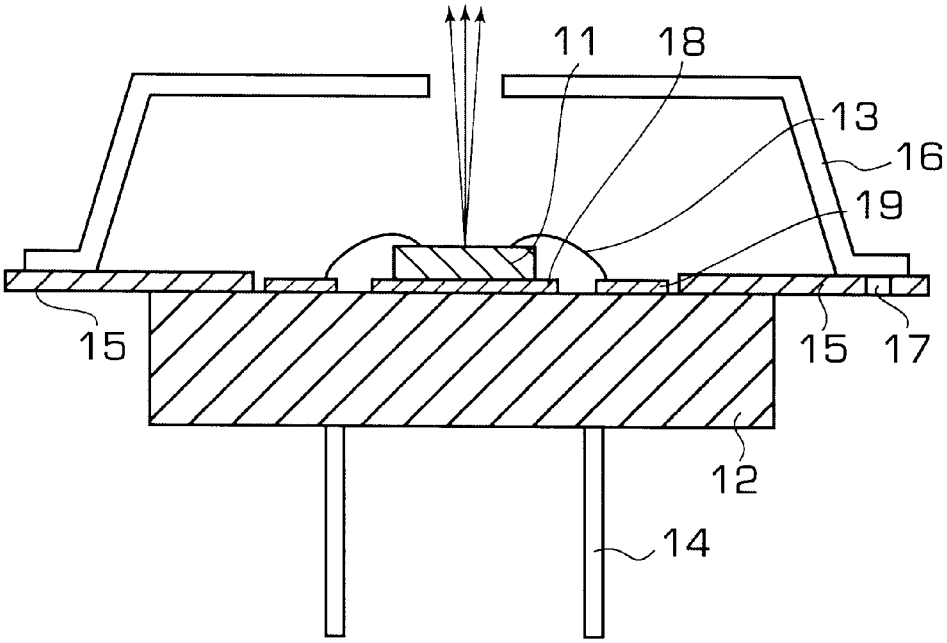
FIG. 7*b* is an enlarged sectional view taken along line A–A' in FIG. 7*a* (including a first grid electrode)

FIG. 7*a* is a plan view of a field emission cathode structure body according to a field emission cathode supporting structure of the present invention, and FIG. 7*b* is an enlarged sectional view taken along line A–A' of FIG. 7*a*. It is to be noted that, in the sectional view, also a first grid electrode of an electron lens is shown.

The field emission cathode structure body shown in FIGS. 7*a* and 7*b* includes ceramic substrate 12, metal flange 15 and terminals 14. Field emission cathode mounting patterns 18 and wire bonding patterns 19 are formed on the surface of ceramic substrate 12. The patterns 18 and 19 are plated with gold. Metal flange 15 is brazed to the upper surface of ceramic substrate 12. Three field emission cathode mounting reference holes 17 which are used as references when field emission cathodes 11 are to be mounted and four electron lens assembly reference holes 20 are provided on metal flange 15.

As the size of the field emission cathode mounting reference holes 17 decreases, the magnification of a microscope for detection of a reference hole can be raised, and consequently, the detection accuracy of the hole position is raised. Meanwhile, in order to assure the strength upon assembly and suppress warping, the metal flange 15 requires a certain thickness and requires, for example, approximately 0.2 mm of thickness. The hole diameter with which holes can be perforated in a plate of this thickness by press work is at least larger than 0.2 mm which is equal to the thickness of the plate. From the requirements described and the practicability, the diameter of the field emission cathode mounting reference holes 17 is approximately 0.2 mm.

The terminals 14 are electrically connected individually to the field emission cathode mounting patterns 18 and the wire bonding patterns 19. On each of the field emission cathodes, three electrodes of the cathode, gate and focusing electrodes are formed. Accordingly, the required number of the terminals 14 is 3 (chips)×3 (electrodes)=9. (From the simplicity in production, 12 terminals are normally provided with a pitch of 2.54 mm.) The positional relationship of field emission cathodes 11 with metal flange 15 in a horizontal plane is set by three field emission cathode mounting reference holes 17, while the positional relationship of the grid electrodes including the first grid electrode with the metal flange 15 in a horizontal plane is set by the four electron lens assembly reference holes 20, and the gap between the field emission cathodes 11 and the first grid electrode 16 is defined by the thickness of the field emission cathodes 11 themselves.

(Embodiment 2)

Figure 8A:
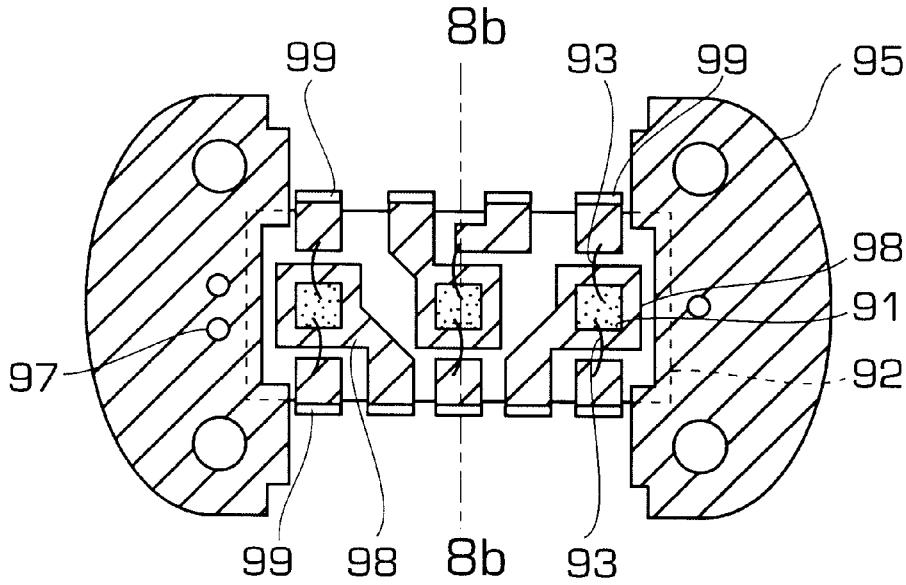
FIG. 8*a* is a plan view of a field emission cathode structure body showing a second embodiment of the field emission cathode supporting structure of the present invention.
Figure 8B:
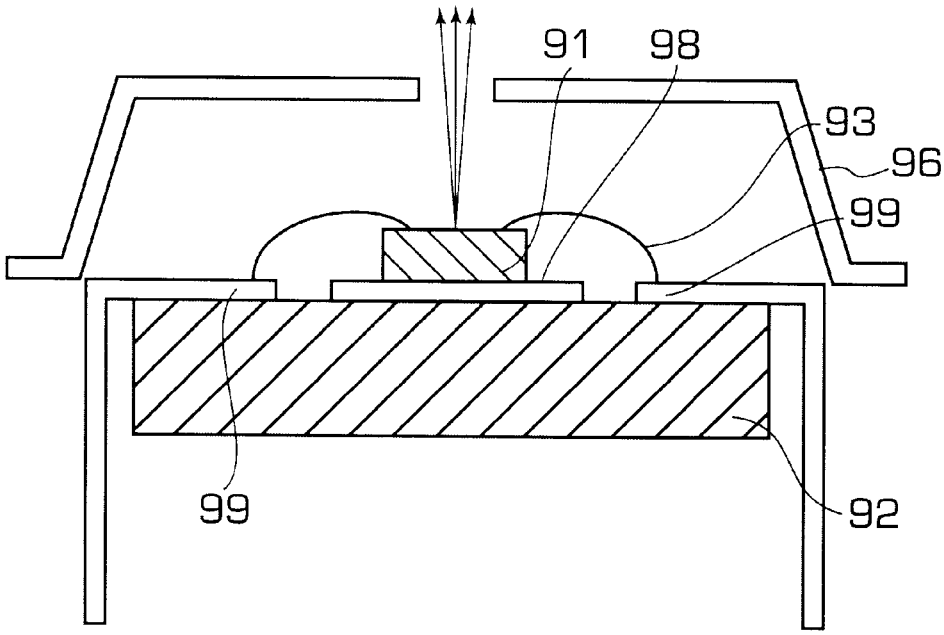
FIG. 8*b* is an enlarged sectional view taken along line A–A' in FIG. 8*a*.

Next, a field emission cathode structure body of a second embodiment of the field emission cathode supporting structure according to the present invention is described with reference to FIGS. 8*a*, 8*b* and 9*a* to 9*d*. FIGS. 8*a* and 8*b* are a plan view and a sectional view taken along A–A' of the field emission cathode structure body of the second embodiment, respectively. FIGS. 9*a*, 9*b*, 9*c* and 9*d* are plan views illustrating a process of production of the field emission cathode structure body of the second embodiment.

Also in the structure of the second embodiment shown in FIGS. 8*a* and 8*b*, metal flange 95 is brazed to the upper surface of ceramic substrate 92.

Field emission cathodes 91 are mounted on mounting portions 98 which are part of the metal flange. Also bonding wires 93 are bonded to bonding portions 99 which are another part of the metal flange. Extensions of the mounting portions 98 and bonding portions 99 are bent down and connected as terminals to the outside. First grid electrode 96 is secured by welding to metal flange 95.

Figures 9A, 9B, 9C, 9D:
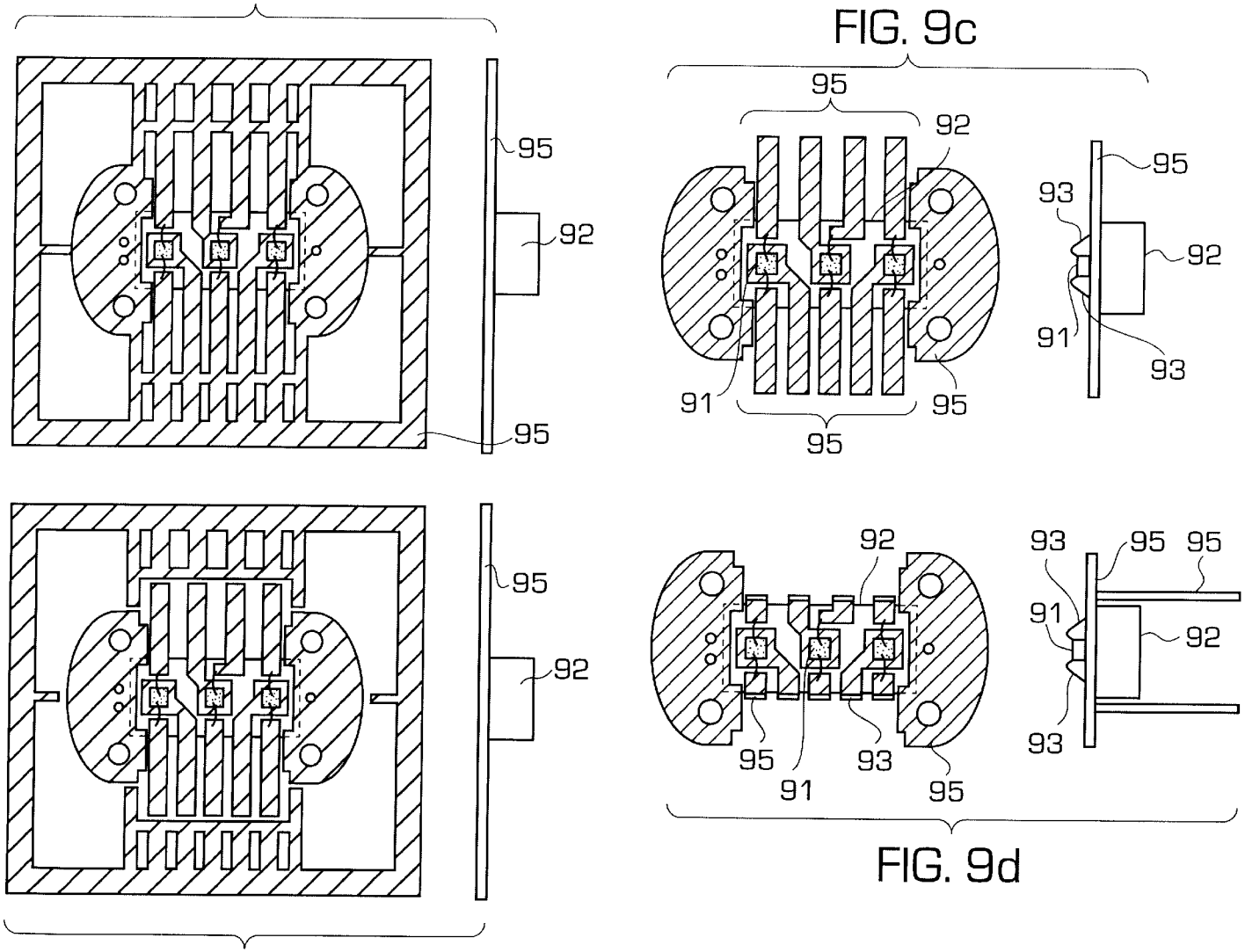
FIGS. 9*a*, 9*b*, 9*c* and 9*d* are views illustrating a process of production of the field emission cathode structure body of FIGS. 8*a* and 8*b* .

FIG. 9*a* shows a field emission cathode structure body wherein ceramic substrate 92 is welded to metal flange 95 in the form of a lead frame. FIG. 9*b* illustrates a condition wherein unnecessary portions of metal flange 95 are cut off. FIG. 9*c* illustrates another condition wherein field emission cathodes 91 are mounted and bonding wires 93 are bonded. FIG. 9*d* illustrates a further condition wherein portions of metal flange 95 are bent to form terminals.

Differences between the first and second embodiments are described below.

While the metal flange of the embodiment 1 is produced by perforating holes in a flat plate by press work, the metal flange of the embodiment 2 is in the form of a lead frame. The metal flange of the embodiment 2 is characterized in that part of the metal flange can be used as the mounting portions for the field emission cathodes and the wire bonding portions.

In regard to the structure and the function of the ceramic substrate, while, in the embodiment 1, the patterns for device mounting and for wire bonding are formed on the upper surface of the ceramic substrate and the patterns for terminal connection are formed on the lower surface of the ceramic substrate, in the embodiment 2, only the pattern for securing the metal flange is formed on the upper surface of the ceramic substrate. Also in regard to the function, while, in the embodiment 1, the ceramic substrate has, in addition to the securing function for the metal flange, the chip mounting function and the electric connection and external outputting functions, in the embodiment 2, the ceramic substrate has only the securing function for the metal flange.

Further, in regard to the terminals, while, in the embodiment 1, the terminals are brazed to the lower surface of the ceramic substrate, in the embodiment 2, portions of the metal flange are bent and used as terminals.

What is claimed is:

1. A field emission cathode supporting structure for assembly of an electron gun of a cathode ray tube, comprising:

at least one field emission cathode having multiple micron size field emission type cathodes formed on a conductive substrate and a gate electrode which applies a voltage to said field emission cathode;

a ceramic substrate for mounting said field emission cathode on the upper surface thereof; and a metal flange for supporting said ceramic substrate; wherein said metal flange is fixed at the upper surface of said ceramic substrate and is entirely parallel thereto, and wherein said metal flange which supports said ceramic substrate further supports the nearest one of the grid electrodes of said electron gun which focuses and accelerates a flow of electrons discharged from said field emission cathode.

2. A field emission cathode supporting structure as claimed in claim 1, wherein said metal flange has positioning reference holes for defining a position for said field emission cathode on said ceramic substrate.

3. A field emission cathode supporting structure as claimed in claim 1, wherein said field emission cathode includes a focusing electrode which surrounds the peripheral edge of said gate electrode.

4. A field emission cathode supporting structure as claimed in claim 3, wherein said ceramic substrate has a mounting portion for said field emission cathode and bonding portions for the gate electrode and the focusing electrode provided on the upper surface thereof and has connection means provided therein for connecting the mounting portion and the bonding portions to terminals provided on the lower surface of said substrate or outside said substrate.

5. A field emission cathode supporting structure as claimed in claim 1, wherein said metal flange and said ceramic substrate accommodate three field emission cathodes.

6. A field emission cathode supporting structure as claimed in claim 1, wherein said ceramic substrate has a mounting portion for said field emission cathode and bonding portions for the gate electrode and the focusing electrode provided on the upper surface thereof, and wherein the mounting portion and the bonding portions are connected to terminals provided on the lower surface of said substrate or outside said substrate.

7. A field emission cathode supporting structure for assembly of an electron gun of a cathode ray tube, comprising:

at least one field emission cathode having multiple micron size field emission type cathodes formed on a conductive substrate and a gate electrode which applies a voltage to said field emission cathode;

a ceramic substrate for mounting said field emission cathode on the upper surface thereof; and a metal flange attached to said ceramic substrate; wherein at least a portion of said metal flange supports said ceramic substrate, and said portion of said metal flange is fixed at the upper surface of said ceramic substrate and is parallel thereto, and wherein said portion of said metal flange which supports said ceramic substrate further supports the nearest one of the grid electrodes of said electron gun which focuses and accelerates a flow of electrons discharged from said field emission cathode.

8. A field emission cathode supporting structure as claimed in claim 7, wherein said portion of said metal flange has positioning reference holes for defining a position for said field emission cathode on said ceramic substrate.

9. A field emission cathode supporting structure as claimed in claim 7, wherein said field emission cathode includes a focusing electrode which surrounds the peripheral edge of said gate electrode.

10. A field emission cathode supporting structure as claimed in claim 7, wherein said ceramic substrate has a mounting portion for said field emission cathode and bonding portions for the gate electrode and the focusing electrode provided on the upper surface thereof and wherein the mounting portion and the bonding portions are connected to terminals provided on the lower surface of said substrate or outside said substrate.

11. A field emission cathode supporting structure as claimed in claim 10, wherein at least some part of said metal flange which is not parallel to the upper surface of said ceramic substrate is bent downwards to form at least one terminal for connecting said field emission cathode supporting structure to external circuitry.

12. A field emission cathode supporting structure as claimed in claim 11, wherein at least some part of said metal flange forms said mounting portion and said bonding portions.

13. A field emission cathode supporting structure as claimed in claim 7, wherein at least some part of said metal flange which is not parallel to the upper surface of said ceramic substrate is bent downwards to form at least one terminal for connecting said field emission cathode supporting structure to external circuitry.

14. A field emission cathode supporting structure as claimed in claim 7, wherein said metal flange and said ceramic substrate accommodate three field emission cathodes.

* * * * *

UNITED STATES PATENT AND TRADEMARK OFFICE

CERTIFICATE OF CORRECTION

PATENT NO. : 6,137,215
DATED : October 24, 2000
INVENTOR(S) : Yuji Kondo, et. al.

It is certified that error appears in the above-identified patent and that said Letters Patent is hereby corrected as shown below:

Column 4, line 43, delete "±100m" insert --±100μm--.

Signed and Sealed this

Twenty-second Day of May, 2001

*Attest:*

Nicholas P. Godici

NICHOLAS P. GODICI

*Attesting Officer*

*Acting Director of the United States Patent and Trademark Office*